United States Patent [19]

Bortolani et al.

[11] Patent Number: 5,076,436

[45] Date of Patent: Dec. 31, 1991

[54] VACUUM PACKAGING

[75] Inventors: Ermanno Bortolani, Milan, Italy; Enzo Vassarotti, Rolle, Switzerland

[73] Assignee: W. R. Grace & Co.-Conn., Duncan, S.C.

[21] Appl. No.: 536,047

[22] Filed: Jun. 11, 1990

Related U.S. Application Data

[60] Continuation of Ser. No. 320,739, Mar. 8, 1989, abandoned, which is a division of Ser. No. 551,373, Nov. 10, 1983, Pat. No. 4,833,862.

[30] Foreign Application Priority Data

Nov. 15, 1982 [IT] Italy ..... 24264 A/82

[51] Int. Cl.[5] ..... B65D 81/20; B65B 11/52

[52] U.S. Cl. ..... 206/524.8; 53/427; 53/433; 53/509; 206/497; 426/125; 426/396

[58] Field of Search ..... 426/125, 129, 396; 229/25 R; 206/471, 497, 524.8; 53/427, 432, 433, 453, 509, 511, 440; 220/306, 359, 258

[56] References Cited

U.S. PATENT DOCUMENTS

| | | | |
|---|---|---|---|
| Re. 27,136 | 6/1971 | Schmidt | 53/427 |
| T857,001 | 12/1968 | Fells | 53/427 |
| 2,942,390 | 6/1960 | Lerner | 53/432 |
| 2,958,172 | 11/1960 | La Branche | 53/509 |
| 3,101,864 | 8/1963 | Glickman | 220/306 |
| 3,119,540 | 1/1964 | Schenk et al. | 229/114 X |
| 3,151,799 | 10/1964 | Engles, Jr. et al. | 426/129 X |
| 3,153,505 | 10/1964 | Bessett | 206/45.14 |
| 3,216,832 | 11/1965 | King | 426/129 X |
| 3,247,643 | 4/1966 | Bartelt | 53/511 X |
| 3,299,604 | 1/1967 | Kraut | 53/427 |
| 3,335,848 | 8/1967 | Frankenberg et al. | 206/45.34 |
| 3,371,848 | 3/1968 | Ward et al. | 229/2.5 R |
| 3,385,424 | 5/1968 | Thompson et al. | 206/497 X |
| 3,398,500 | 8/1968 | Inman | 53/432 |
| 3,467,244 | 9/1969 | Mahaffy et al. | 53/433 X |
| 3,481,101 | 12/1969 | Steadman | 53/433 X |
| 3,492,773 | 2/1970 | Bergstrom | 53/433 |
| 3,563,445 | 2/1971 | Clayton | 426/129 X |
| 3,648,428 | 3/1972 | Colburn | 53/433 X |
| 3,694,991 | 10/1972 | Perdue et al. | 53/433 X |
| 3,792,181 | 2/1974 | Mahaffy et al. | 426/129 X |
| 3,946,870 | 3/1976 | Gajer et al. | 206/472 |
| 3,956,867 | 5/1976 | Utz et al. | 53/433 |
| 3,972,155 | 8/1976 | Mahaffy et al. | 53/453 |
| 4,058,953 | 11/1977 | Sanborn, Jr. et al. | 53/433 |
| 4,133,430 | 1/1979 | Cravens | 206/497 |
| 4,208,007 | 6/1980 | Bamburg et al. | 229/119 |
| 4,223,513 | 9/1980 | Mahaffy et al. | 53/432 |
| 4,240,241 | 12/1980 | Sanborn, Jr. et al. | 53/433 X |
| 4,277,931 | 7/1981 | Mahaffy et al. | 53/433 X |
| 4,308,711 | 1/1982 | Mahaffy . | |

FOREIGN PATENT DOCUMENTS

| | | | |
|---|---|---|---|
| 1511668 | of 0000 | Fed. Rep. of Germany . | |
| 2327286 | of 0000 | Fed. Rep. of Germany . | |
| 2352800 | of 0000 | Fed. Rep. of Germany . | |
| 2550479 | of 0000 | Fed. Rep. of Germany . | |
| 2751100 | of 0000 | Fed. Rep. of Germany . | |
| 2808836 | of 0000 | Fed. Rep. of Germany . | |
| 834170 | of 0000 | Finland . | |
| 160184 | of 0000 | France . | |
| 2291008 | of 0000 | France . | |
| 53-89590 | 8/1978 | Japan . | |
| 54-104995 | 8/1979 | Japan . | |
| 580521 | of 0000 | Switzerland . | |
| 0620647 | of 0000 | Switzerland . | |
| 1296013 | of 0000 | United Kingdom . | |
| 1393277 | of 0000 | United Kingdom . | |
| 1547472 | of 0000 | United Kingdom . | |
| 1558134 | of 0000 | United Kingdom . | |
| 1299443 | 12/1972 | United Kingdom | 229/2.5 R |
| 2057388 | 4/1981 | United Kingdom . | |

*Primary Examiner*—Bryon P. Gehman

*Attorney, Agent, or Firm*—William D. Lee, Jr.; Mark B. Quatt; Jennifer L. Skord

[57] ABSTRACT

In a vacuum skin package wrinkles and weak spots are avoided by providing a tray as the support or backing member rather than a flat sheet, the angle of the walls as they diverge outwardly being 91° to 160°. Especially useful is such a package when provided with a lid for stacking purposes.

1 Claim, 2 Drawing Sheets

VACUUM PACKAGING

This application is a continuation of application Ser. No. 320,739 filed on Mar. 8, 1989, now abandoned, which is a division of U.S. Pat. No. 4,833,862 issued on May 30, 1989.

FIELD OF INVENTION

This invention relates to a method and an apparatus for vacuum packaging, particularly for packaging food products in skin packages.

BACKGROUND

Known are several methods for imparting special characteristics to vacuum packages for food products; as an example, U.S. Pat. No. 3,792,181 which issued on Feb. 12, 1974 to Reid A. Mahaffy et al. discloses a container of a semirigid plastic material shaped to accommodate a detachable lid.

This prior container, while affording definite advantages, requires a shape as close and as similar as possible to the shape and dimensions of the product to be placed therein and thus it lacks desired versatility. An improvement on this packaging technique has been achieved by arranging articles to be packaged onto a supporting sheet-like material, which is then covered with a polymeric film; and thereafter, the volume included between the film, sheet-like material, and product is sealed by application of a pneumatic vacuum.

Such approaches, e.g., as described in U.S. Pat. No. 3,694,991 which issued Oct. 3, 1972 to Richard R. Perdue et al. need improvement as regards loading of the products into the package supporting sheet number, because its arrangement on such a sheet-like material prevents the product from being directly and definitively seated, and there may occur instances of improper arrangement of articles inside the packages.

Another problem, pointed out in detail in Italian Patent Application 21030 A/82 filed Apr. 30, 1982 by W. R. Grace & Co. (E. Bartolani et al., inventors) arises from the formation of folds in the film, especially along the vertical corners of the product being packaged.

The problem is further aggravated where, as is usual, the products to be packaged are arranged side-by-side on a web of sheet-like material for simultaneous packaging of several products preliminarily to subsequent severing of the sheet-like material to separate the individual packages.

In that case, on account of the cited folds spanning considerable distances, it often occurs that the sheet-like material is severed at areas affected by said folds, thus causing air to seep into the packages.

It should be also considered that the upper film has areas particularly weakened in the proximities of the areas of connection to the sheet-like material, which are due to the high stretch to which the film is subjected during the packaging step.

In the light of the foregoing technical problems, it is a primary object of this invention to remove such prior drawbacks by providing a method of vacuum packaging which can eliminate the dimensional dependence of the container on the product it must accommodate.

Another important object of the invention is to provide a method which can combine good aesthetic characteristics with ease of loading the product during the packaging step, attenuation of the folds in the upper film with full elimination of their damaging effect and considerable strengthening of the package, which is apt to facilitate its handling and avoid deformation of the package under the action of the applied vacuum.

A further object of the invention is to provide an apparatus to implement the above method.

It is another object of this invention to provide a vacuum package having no voids in its interior.

In addition, an object of the invention is to provide a vacuum package with enhanced properties of presentation and outward appeal of the packaged product.

Yet another object of this invention is to provide a vacuum package of low cost and great convenience, and, above all, one combining all of the advantages set forth hereinabove.

SUMMARY OF THE INVENTION

The above and other objects are achieved by a method and apparatus for vacuum packaging comprising the steps of placing at least one productarticle onto a supporting sheet-like material and covering said productarticle with a film sealed on said supporting sheet-like material by the application of a pneumatic vacuum around the article or product articles and between the supporting sheet-like material and said film, characterized in that it comprises the step of thermoforming said supporting sheet-like material to impart a substantially tray-like configuration thereto with raised peripheral edges. The raised edges may be upwardly diverging walls. The invention also comprises the product produced by either said method or apparatus.

DESCRIPTION OF THE DRAWINGS

Further features and advantages of the invention will be more clearly understood from the following description of a preferred but not limitative embodiment of this apparatus for vacuum packaging and of a package obtained with said apparatus, with reference to the accompanying illustrative drawings, where.

DETAILED DESCRIPTION

Figure 1:
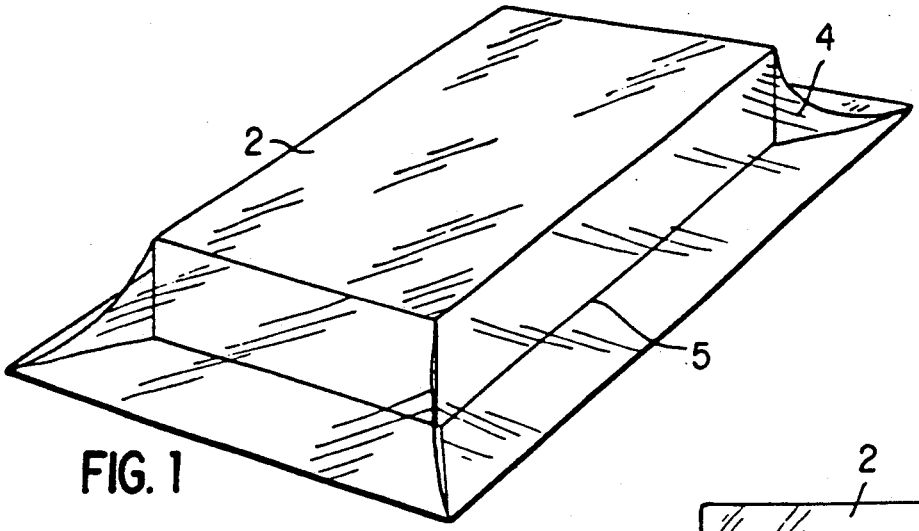
FIGS. 1 to 3 show a perspective view, side elevation view, and sectional view taken in the plane A—A of the fold illustrated in FIG. 2, respectively, with reference to a conventional vacuum package.
Figure 2:
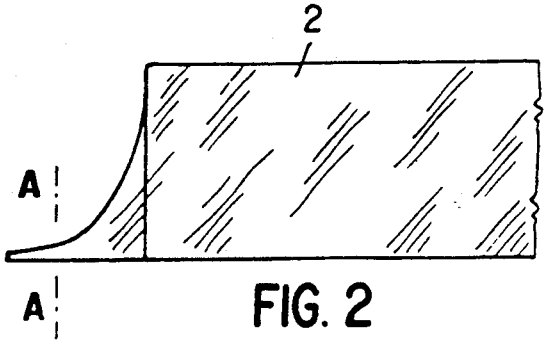
Figure 3:
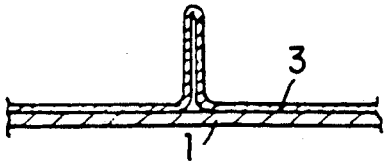

Making reference to FIGS. 1 to 3, some of the problems encountered in conventional vacuum skin packages may be observed, for example in a vacuum package as shown in the abovementioned U.S. Pat. No. 3,694,991.

Such packages generally comprise a supporting sheet-like material 1 whereon a product 2 to be packaged is deposited.

The whole assembly is then covered with a film 3 which is sealed to the sheet-like material, and a high negative pressure is created there-within such that the package is practically in a vacuumed condition.

Along the corner edges, the excess film 3 is gathered into folds 4 which extend over a certain length across the sheet-like material. Now, considering that a packaging line operates with a number of products arranged parallel to one another and after enclosure, the product containing packages are subsequently severed from one another by means of a cutter, it will be apparent that, if the cut area includes a fold portion, such as shown by the dash-line A—A in FIG. 2, the section whereof is represented in FIG. 3, then there may occur air seepage into the package, with attendant deterioration of the preserving properties which characterize this type of packaging.

In actual practice, it has been found that said occurrence is more apparent in the lateral products of a packaging web, it being presumed that the folds can be better accommodated if a side-by-side product arrangement is used.

From the above mentioned patent application 21030 A/82 it is in fact evident that to solve the problem a "dummy product" element arranged along the edges of the sheet-like material web is utilized.

Conventional packages, moreover, have a marginal or peripheral area of significant weakening of the upper film 3 at margin 5 as indicated in FIG. 1. This area approximately corresponds or follows the perimeter of the area of contact between the sealed film-product assembly 2 and the sheet-life material.

This area 5 is in fact subjected to maximum plastic deformation during the application steps, and accordingly grows thinner to the point of constituting a critical element in the whole package.

During handling and shipping, in fact, contacts and impacts may occur between packages, which, when affecting the area 5, can result in damage to the packaged product.

Figure 4:
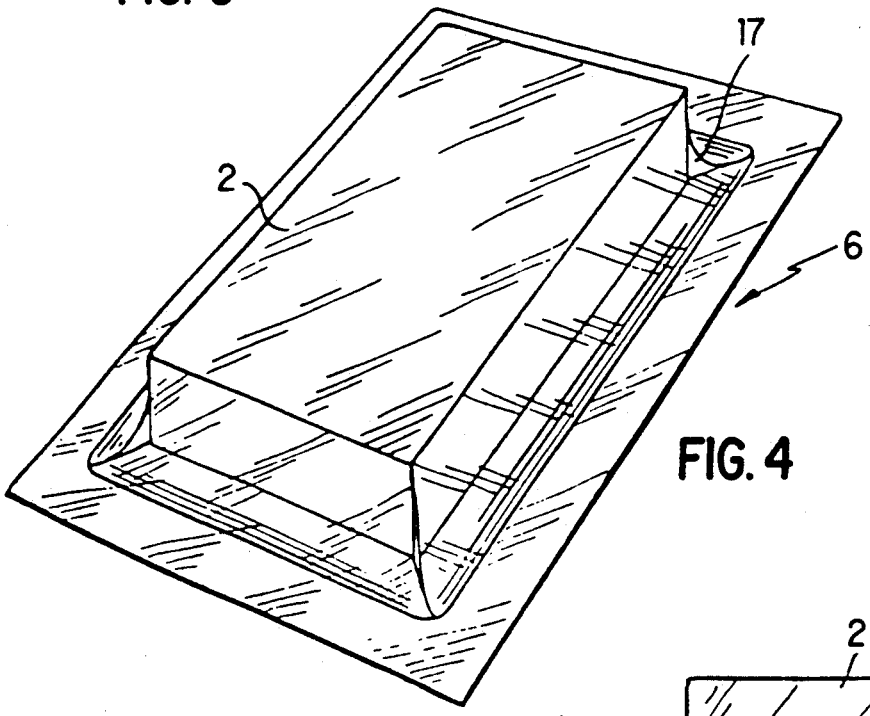
FIGS. 4 to 6 show similar views of an inventive vacuum package, among which a sectional view taken in the plane B—B.

FIG. 4 shows a vacuum package according to the invention which is generally indicated at 6.

It also comprises a supporting sheet-like material 7 on which a product-article 2 is arranged, which is wrapped across its surfaces not contacting the sheet-like material, in a polymeric film 8 which is sealed to the supporting sheet-like material by the application of a pneumatic vacuum around the article or product-articles and between the supporting sheet-like material and the film.

According to the invention, the supporting sheet-like material has a substantially tray-like configuration defining a bottom 9 from which walls 10 extend which diverge on the opposite side to the bottom.

It has been found that the values for the angles included between the bottom 9 of the tray and diverging walls 10 should be advantageously selected in the 91° to 160° range, preferably in the 105° to 150° range: this affords, among others, an optimum configuration, both as regards sealing and the mutual arrangement of the contacting tray and film parts.

The bottom 9 has, preferably, an undulated surface which defines a plurality of canals or microchannels intersecting one another to facilitate the extraction of air during the sealing operation; additional canals are defined by grooves 11, extending substantially parallel to one another toward the bottom such as to communicate to said microchannels, again to facilitate the extraction of air.

The supporting sheet-like material preferably comprises a multilayered laminated film having flexibility characteristics which vary according to the product to be packaged and package type.

In accordance with this invention, the upper film 8 is caused to adhere on almost all the surfaces of said product articles not directly in contact with the tray-like sheet-like material such as to provide a smooth sealed cover without voids. The film also adheres on the bottom, walls, and border 12 carried peripherally on the cited walls and substantially parallel to the bottom 9.

The absolute absence of voids within the package avoids, among others, such problems as sucking out liquids in relation with product articles, such as meat, and consequent flowing of such liquids into the package itself.

Also provided is the application along at least a portion of the border 12 extension and preferably at a corner of a non-sticking tab 13 which creates an area of non-adhesion between the upper film and sheet-like material to facilitate film gripping as the package is being opened.

In a preferred embodiment, the border 12 has, along at least a portion of its extension, an engagement element 13*a*, e.g., in the form of a peripheral raised portion, with which a corresponding engagement element 14 may be engaged which is carried on a lid 15 which may be associated with the tray subsequently to the vacuum sealing operations.

The lid affords for the package of this invention the added advantage of enabling it to be closed after the upper film has been removed, which advantage is particularly appreciated where the tray element contains products which are not intended for consumption all at once and for which the inventive package allows the original package to be retained for conservation even during the intermediate consumption stages. The lid, moreover, protects the vacuum package during transportation and advantageously facilitates stacking.

A possible embodiment of the package according to this invention provides for a hole 16 in the border 12 which enables the retailer to suspend the packages from suitable display structures, thus favoring the visual impact of the product on the customer.

Figure 5:
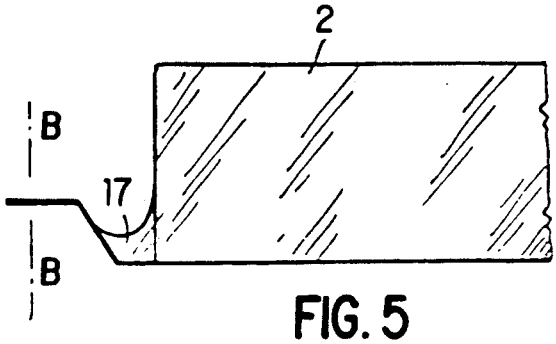
Figure 6:
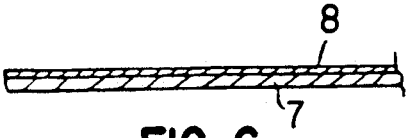
Figure 10:
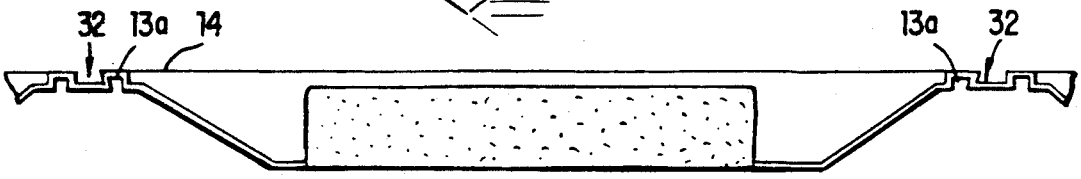
FIG. 10 is a cross-sectional view of the inventive vacuum package, with a protective lid applied thereon.

As illustrated in FIGS. 10 and 5, the sloping walls 10 and border 12 afford a significant reduction in the folds 17 and cause said folds to remain at all times within the inside perimeter of the border, eliminating almost completely those dangers which they presented in conventional packages.

Adhesion of the film 8 on the sheet-like material 7 and the folds 17 themselves define, moreover, a strengthening structure for the package, and in particular the folds 17 behave as stiffening ribs for the tray element. The implementation, according to the invention, of all that has been described affords a high vacuum package rating as regards the presentation and outward apperance aspects of the package, thus enhancing the appearance of the packaged product-article.

Figure 7:
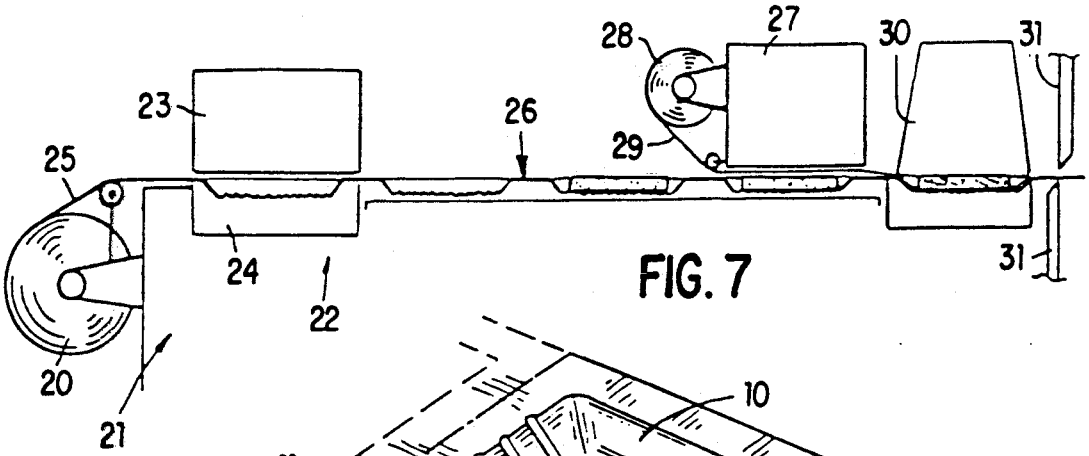
FIG. 7 schematically illustrates the apparatus according to the invention.

In FIG. 7, there is shown an apparatus according to the invention, which comprises a first reel 20, on which is wound the supporting sheet-like material and which is carried rotatably on a bed 21.

Associated with the bed is a thermoforming station 22, preferably comprising a heater element 23 facing a mold element 24 such as to leave between said elements a gap for the passage of the sheet-like material 25.

Both the cited elements are connected to a vacuum source or pump, not shown because of conventional design, and have means for sucking the sheet-like material against either of the surfaces facing it.

Directly downstream of the thermoforming station, on the opposite side to the coil 20, the apparatus has a portion 26 for loading products to be packaged onto the sheet-like material. Downstream of the portion 26, the bed 21 carries a packaging station 27 which carries rotatably a second reel 28 around which the polymeric film 29 is wound.

Figure 9:
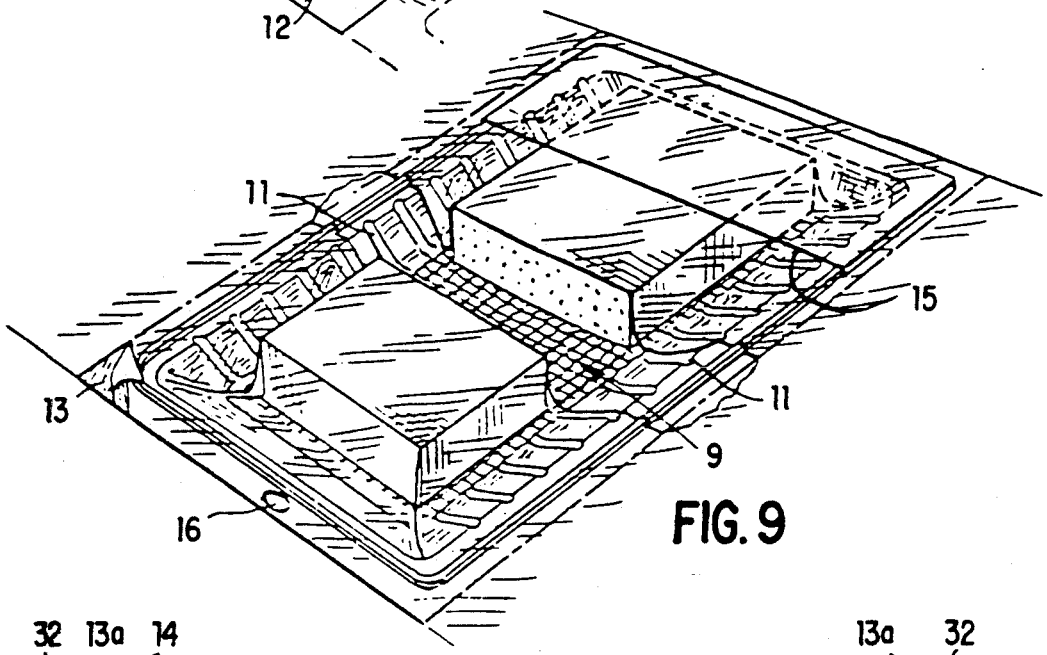
FIG. 9 shows a perspective view, partly in section, of a completed vacuum package.

Within the station 27, the product-sheet-like material assembly is brought to an evacuated condition and sealed by means of the film 29 with a conventional method described in said Italian Patent Application 21030 A/82.

Where it is desired to apply on the package an additional lid 15, as shown in FIG. 9, an applicator of lids 30 of conventional design would be provided downstream of the station 27.

Since in actual practice the width of the sheet-like material is such as to permit the forming of several tray-like elements parallel to one another, the station 27, or possible the assembly 30, is followed by cutting members 31, which subdivide the sealed package web exiting the apparatus into individual packages for subsequent sale.

The operation of the inventive apparatus will be apparent from the foregoing description and accompanying drawings, and is illustrated for further clarification of the functional aspects of the stations which compose it and of the method of packaging under vacuum which said apparatus implement.

The reel 20 supplies sheet-like material to the various assemblies and stations arranged sequentially along the path of the material itself.

Figure 8:
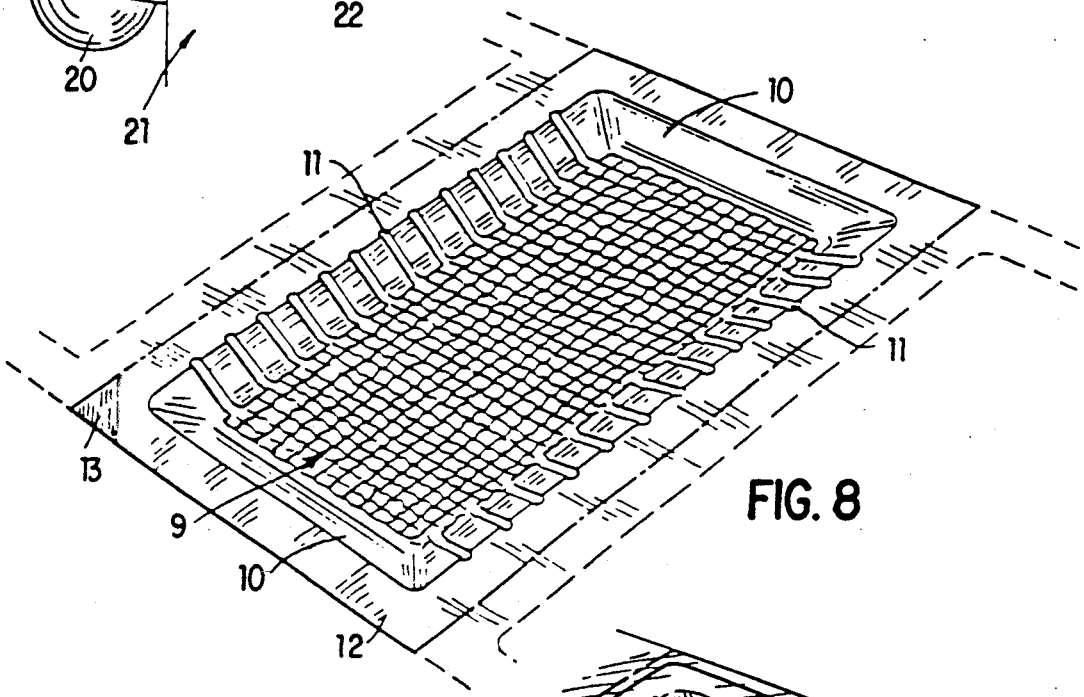
FIG. 8 is a perspective view of the shape taken by the supporting sheet-like material following the thermoforming step.

The first station supplied is the thermoforming station, wherein the sheet-like material takes on a permanent deformation of a substantially tray-like configuration with raised edges as shown in FIG. 8.

To achieve said deformation, initially the heater element draws the film of sheet-like material, e.g., multilayered polymeric film, against the surface of the heater element facing said material.

During this step, the material 25 is heated, e.g. by electric resistor heaters contained in the element 23 to acquire adequate plastic properties. Upon achieving this object, suction is discontinued on the element 23 side, and suction is started on the mold element 24 side, such that the hot sheet-like material can reproduce the shape of the mold element, and, in contacting the cold surface, be restored to its initial rigidity.

It is accordingly necessary to arrange for the feeding of the sheet-like material 25 to occur intermittently, which does not hinder the correct operation of the machine because the same type of feed is required by the station 27.

Of course, the thermoforming operation may be carried out by means of any other suitable method which can lead, as the final result, to a permanent deformation of the sheet-like element in accordance with the tray-like configuration described above. Merely as an example, among the prior methods, are those methods using cooperating mold and die systems, whether of the mechanical or fluid dynamic types.

Along the portion 26, the products to be packaged are arranged into the tray-like configured elements, with an evident practical advantage over conventional machines because this allows an accurate positioning of the products and not the chance arrangement possibly identified by detents on the bed 21.

More evident is the advantage over prior thermoformed packages because the tray-like configuration is adapted to accommodate products with different shapes and dimensions without requiring modification of the mold element.

The tray/product assemblies thus reach the packaging station 27 where, in a known manner, they are vacuum sealed through application of the film 29.

Where application of the lids 15 is provided, the mold element 24 pre-arranges the tray elements forming the engagement elements 13*a* along portions or possibly along the entire perimeter of the border 12 to allow the assembly 30 to correctly install the cited lids.

Since, as previously set forth, the tray elements and consequently the sealed packages exit the station 27 in the form of a continuous web having a plurality of mutually parallel packages as illustrated in FIG. 8, the cutting members 31 provide for the separation of the individual packages e.g. at the portion indicated by arrows 32 in FIG. 10.

It has been ascertained in practice that the apparatus so described can easily bring about significant improvements to the vacuum packaging methods known heretofore, with simplicity and rationality without requiring significant modification to conventional machines and hence with considerable economy of production.

The invention so conceived is susceptible to many modifications and variations all of which fall within the scope of the inventive concept. Moreover, all of the details may be replaced with other technically equivalent elements.

In practice the materials employed and the dimensions may be any ones, depending on requirements and the state of the art.

We claim:

1. A package prepared by using a vacuum skin packaging process comprising:

a) a thermoformed tray having a substantially flat bottom with outwardly diverging walls extending upwardly from said bottom, the angle included between said walls and said bottom being between 105° to 150°, said tray being constructed from a thermoformable polymeric material and the walls and bottom of said tray being of one continuous, uncut material;

b) a product positioned on the tray bottom, said product being spaced apart from the walls so that there is a peripheral area of the tray bottom around the product which is not covered by the product in order to permit the sealing of a covering film to the tray bottom around the periphery of the product thereby permitting viewing of the side of the product without obstruction from the tray walls, said product being lower in height than said tray walls;

c) a border around the upper margins of the outwardly diverging walls, said border being substantially parallel to the tray bottom;

d) a covering film of transparent, polymeric film very closely conforming to the shape of the product in a skinlike fashion, said film being sealed to the tray bottom around the periphery of the product and onto and at least partially up the diverging walls whereby said film is formed around the product on the tray bottom;

e) a lid engaging said border and being spaced apart from the product, said lid engaging said border and being supported thereby;

f) the space which contains said product and which is bounded by said covering web and said tray bottom being substantially evacuated having been evacuated through application of a vacuum skin packaging process.

* * * * *